US009684255B2

(12) United States Patent
Egawa et al.

(10) Patent No.: US 9,684,255 B2
(45) Date of Patent: Jun. 20, 2017

(54) COATING AGENT AND METHOD FOR PRODUCING ELECTROPHOTOGRAPHIC MEMBER

(71) Applicant: CANON KABUSHIKI KAISHA, Tokyo (JP)

(72) Inventors: Noriaki Egawa, Komae (JP); Eiichi Hamana, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 216 days.

(21) Appl. No.: 14/720,570

(22) Filed: May 22, 2015

(65) Prior Publication Data

US 2015/0346618 A1 Dec. 3, 2015

(30) Foreign Application Priority Data

May 27, 2014 (JP) ..... 2014-109048
Mar. 20, 2015 (JP) ..... 2015-057750

(51) Int. Cl.

| | |
|---|---|
| ***G03G 5/08*** | (2006.01) |
| ***G03G 5/07*** | (2006.01) |
| ***G03G 5/14*** | (2006.01) |
| ***G03G 5/147*** | (2006.01) |

(52) U.S. Cl.
CPC ..... *G03G 5/14704* (2013.01); *G03G 5/14713* (2013.01); *G03G 5/14795* (2013.01)

(58) Field of Classification Search
CPC ..... G03G 5/08; G03G 5/071; G03G 5/14704; G03G 5/14713; G03G 5/14795
USPC ..... 524/186
See application file for complete search history.

(56) References Cited

U.S. PATENT DOCUMENTS 8,791,204 B2 * 7/2014 Choudhery ..... C08J 3/11 525/119

FOREIGN PATENT DOCUMENTS

| | | | |
|---|---|---|---|
| CN | 102250370 A | * | 11/2011 |
| JP | 2007-316371 A | | 12/2007 |
| JP | 2007316371 A | * | 12/2007 |

* cited by examiner

*Primary Examiner* — Michael M Bernshteyn
(74) *Attorney, Agent, or Firm* — Canon U.S.A. Inc., IP Division

(57) ABSTRACT

Provided is a coating agent having a polymerizable compound containing a hydroxyl group in the molecule, conductive inorganic particles whose surface is treated with a dispersing agent having a nitrogen atom in the molecule, and a solvent, in which when the interatomic distance between an oxygen atom of the hydroxyl group and the atom farthest away from the oxygen atom in the molecule of the polymerizable compound is represented by D1 and the interatomic distance between the nitrogen atom and the atom farthest away from the nitrogen atom in the molecule of the dispersing agent is represented by D2, D1 and D2 satisfy the relationship represented by the following formula (1).

$$[(|D1-D2|)/D2] \leq 0.30 \quad \text{Formula (1)}$$

7 Claims, 2 Drawing Sheets

COATING AGENT AND METHOD FOR PRODUCING ELECTROPHOTOGRAPHIC MEMBER

BACKGROUND OF THE INVENTION

Field of the Invention

The present invention relates to a coating agent for forming a conductive coating film and a method for producing an electrophotographic member, such as a conveying transferring belt and an intermediate transferring belt, for use in an electrophotographic image forming apparatus (hereinafter referred to as an "electrophotographic apparatus"), such as a copying machine or a printer.

Description of the Related Art

It is known that the electrophotographic member for use in an intermediate transferring belt and the like has a conductive resin layer containing acrylic resin, urethane resin, and the like on the surface for the purpose of improving toner transfer efficiency and imparting wear resistance. For the formation of the conductive resin layer, a coating liquid (hereinafter sometimes referred to as a "coating agent") is used which contains raw materials of resin and conductive inorganic fine particles.

With respect to such a coating liquid, Japanese Patent Laid-Open No. 2007-316371 discloses that inorganic fine particles are uniformly dispersed in the coating liquid using a specific dispersion assistant, whereby the life of the coating liquid can be extended.

SUMMARY OF THE INVENTION

One aspect of the present invention is directed to providing a coating agent which gives a conductive resin film exhibiting a desired electrical resistance value irrespective of the elapsed time from the preparation thereof. One aspect of the present invention is directed to providing a conductive resin film having stable conductivity.

Another aspect of the present invention is directed to providing a method for producing an electrophotographic member having a conductive resin layer having stable conductivity.

Another aspect of the present invention is directed to providing a method for producing an electrophotographic member having a conductive resin layer with less variation.

According to one aspect of the present invention, there is provided a coating agent containing a polymerizable compound having a hydroxyl group in the molecule, conductive inorganic particles whose surface is treated with a dispersing agent having a nitrogen atom in the molecule, and a solvent, in which when the interatomic distance between an oxygen atom of the hydroxyl group and the atom farthest away from the oxygen atom in the molecule of the polymerizable compound is represented by D1 and the interatomic distance between the nitrogen atom and the atom farthest away from the nitrogen atom in the molecule of the dispersing agent is represented by D2, D1 and D2 satisfy the relationship represented by the following formula (1).

$$[(|D1-D2|)/D2] \leq 0.30 \qquad \text{Formula (1)}$$

According to another aspect of the present invention, there is provided a conductive resin film which is obtained by applying the coating agent onto a substrate, and then curing the same.

According to another aspect of the present invention, there is provided an electrophotographic member having a substrate and a cured film of a coating film of the coating agent formed on the substrate.

According to another aspect of the present invention, there is provided a method for producing an electrophotographic member having a substrate and a conductive resin film formed on the substrate, the method which includes a process of applying the coating agent onto the substrate to form a coating film, and a process of curing the coating film.

According to another aspect of the present invention, there is provided a method for mass-producing an electrophotographic member having a substrate and a conductive resin film formed on the substrate, the method which includes (a) a process of forming a coating film of the coating agent on the substrate and (b) a process of curing the coating film formed in the process (a) to form a conductive resin film, in which the process (a) is repeatedly performed on a plurality of substrates to produce a plurality of electrophotographic members.

Further features of the present invention will become apparent from the following description of exemplary embodiments with reference to the attached drawings.

DESCRIPTION OF THE EMBODIMENTS

As a result of an investigation performed by the present inventors, it is found that, even in the case of a coating agent as described in Japanese Patent Laid-Open No. 2007-316371, of which the dispersibility of inorganic fine particles is improved by using a dispersing agent, and a good dispersion state of the inorganic fine particles is maintained, the conductivity is different between a surface layer formed by using the coating agent immediately after the preparation thereof and a surface layer formed by using the coating agent of which a certain period of time has been lapsed from the preparation thereof.

The present inventors have repeatedly examined a cause thereof. During the examination, the present inventors have confirmed that, even in the case of a coating agent of which a certain period of time has been lapsed from the preparation thereof, the uniform dispersion of the inorganic fine particles is maintained. More specifically, the changes in the conductivity of the resin film formed by using the coating of which a certain period of time has been lapsed from the preparation thereof from the conductivity of the resin film formed using the coating agent immediately after the preparation thereof have not been caused by aggregation or sedimentation due to a reduction in the dispersibility of the inorganic fine particles themselves.

Then, as a result of further examining the cause, it has been found that the conductivity has changed according to the following mechanism.

Figure 3:
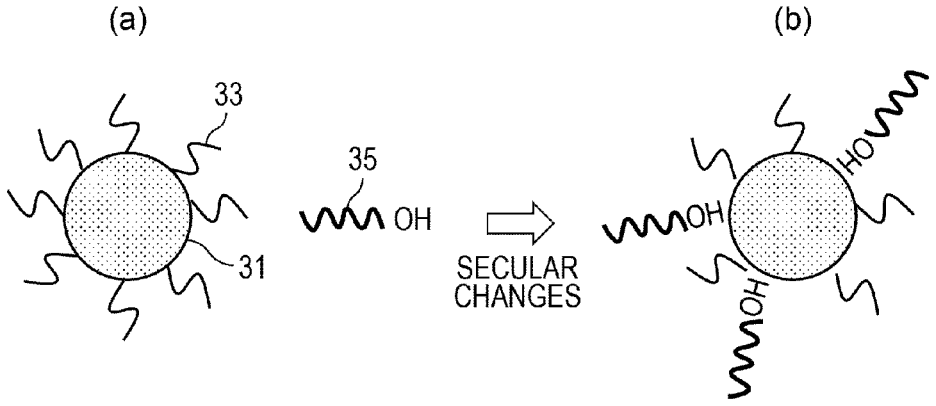
FIG. 3 includes explanatory views of secular changes in a coating agent.

More specifically, in the coating agent containing a polymerizable compound, conductive inorganic particles treated with a dispersing agent having a nitrogen atom in the molecule, and a solvent, the dispersibility of the inorganic particle is maintained due to the fact that dispersing agents 33 are adsorbed to the surface of an inorganic particle 31 at the nitrogen atom in the molecule as an adsorption point as illustrated in a part (a) of FIG. 3. However, when a polymerizable compound 35 having a hydroxyl group in the molecule is present in the coating agent, the affinity of the hydroxyl group and the surface of the inorganic particle is high, so that the polymerizable compound is likely to be adsorbed to the surface of the inorganic particle. Therefore, with the passing of time from the preparation of the coating agent, the polymerizable compound 35 is gradually adsorbed to the surface of the inorganic particle 31 (part (b) of FIG. 3).

Herein, the inorganic particles in the conductive resin film develop conductivity due to the fact that the inorganic particles partially aggregate to form a cohesion cluster, and then the cohesion cluster forms a conductive path. The electrical resistance value of the resin film depends on the distance between the inorganic particles forming the cohesion cluster. Specifically, the electrical resistance value of the resin film further increases with increasing distance between the inorganic particles and the electrical resistance value of the resin film further decreases with decreasing distance. More specifically, when the size of the molecules adsorbing to the surface of the inorganic particles is large, the distance between the inorganic particles becomes large, and, as a result, the electrical resistance value of the resin film becomes high. For example, in the case of a coating agent containing inorganic particles treated with tri-n-butylamine and a coating agent containing inorganic particles treated with tri-n-hexylamine, a resin film formed by the coating agent containing the inorganic particles treated with tri-n-hexylamine with a larger molecule size has had a higher electrical resistance value.

Therefore, in the case where the state is changed from the state where only the dispersing agents are adsorbed to the surface of the inorganic particle in the coating agent immediately after the preparation thereof as illustrated in the part (a) of FIG. 3 to the state where the polymerizable compounds are gradually adsorbed to the surface of the inorganic particle as illustrated in the part (b) of FIG. 3, when the size of the molecules of the dispersing agent and the size of the molecules of the polymerizable compound are different from each other, the distance between the inorganic particles in the resin film formed from the coating agent immediately after the preparation thereof and the distance between the inorganic particles in the resin film formed from the coating agent of which a certain period of time has been lapsedare different. This has been considered to be the cause of the changes in the conductivity between the resin film formed with the coating agent immediately after the preparation thereof and the resin film formed with the coating agent after the lapse of time from the preparation thereof.

Figure 4:
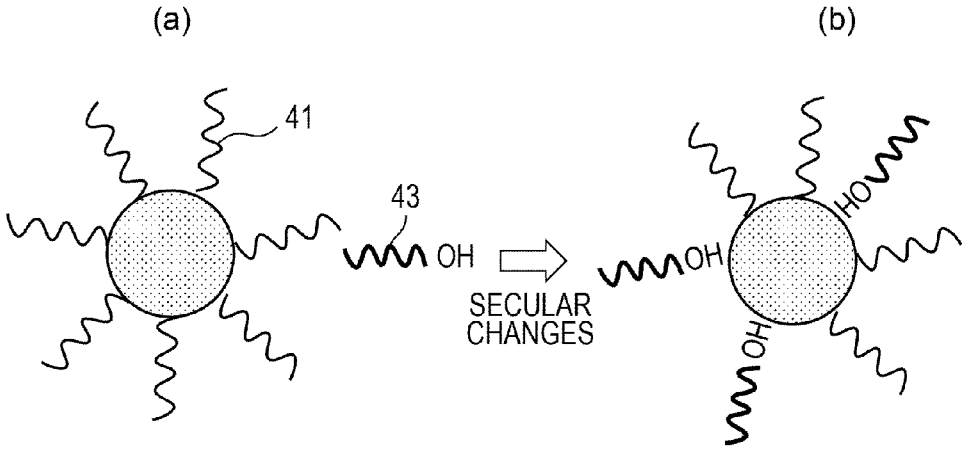
FIG. 4 includes explanatory views of secular changes in one embodiment of a coating agent according to an aspect of the present invention.

As a result of further examination of the cause based on the consideration above, it has been found that the changes in the conductivity of the resin film with the progress of time from the preparation of the coating agent can be suppressed by making the molecular size of the dispersing agent and the molecular size of the polymerizable compound nearly the same. More specifically, as illustrated in a part (a) of FIG. 4, when the molecular size of dispersing agents 41 and the molecular size of polymerizable compounds 43 are made nearly the same, the distance between the inorganic particles in the resin film formed using a coating agent in which the polymerizable compounds 43 are adsorbed to the surface of the inorganic particles due to the lapse of time after the preparation thereof can be made nearly the same as the distance between the inorganic particles in the resin film formed using a coating agent containing the inorganic particles in the state illustrated in the part (a) of FIG. 4 immediately after the preparation of the coating agent. Therefore, it is possible to decrease the likelihood of there being a difference in the conductivity among a plurality of resin films resulting from a difference in the elapsed time from the preparation of the coating agents to be used for the formation of the resin films.

More specifically, the coating agent according to an aspect of the present invention contains a polymerizable compound having a hydroxyl group in the molecule, conductive inorganic particles whose surface is treated with a dispersing agent having a nitrogen atom in the molecule, and a solvent.

In the polymerizable compound and the dispersing agent, the interatomic distances from the adsorption point to the surface of each inorganic particle to the atom farthest away from the adsorption point are nearly the same. More specifically, when the interatomic distance between an oxygen atom of a hydroxyl group serving as the adsorption point to the surface of the inorganic particles and the atom farthest away from the oxygen atom in the molecule of the polymerizable compound is represented by D1 and the interatomic distance between a nitrogen atom serving as the adsorption point of the inorganic particle and the atom farthest away from the nitrogen atom in the molecule of the dispersing agent is represented by D2, D1 and D2 satisfy the relationship represented by the following formula (1).

$$[(|D1-D2|)/D2] \leq 0.30$$

Hereinafter, embodiments of the coating agent and the electrophotographic member according to an aspect of the present invention are described in detail. The present invention is not limited to the following embodiments.

Coating Agent

Hereinafter, one embodiment of the coating agent according to an aspect of the present invention is described in detail.

Constituent Components of Coating Agent

The coating agent contains a polymerizable compound having a hydroxyl group in the molecule, conductive inorganic particles whose surface is treated with a dispersing agent having a nitrogen atom in the molecule, and a solvent.

Polymerizable Compound Having Hydroxyl Group in Molecules

The polymerizable compound is not particularly limited insofar as a hydroxyl group is contained. In order to use the polymerizable compound for electrophotographic members, (meth)acrylate and urethane (meth)acrylate are suitably used from the viewpoint of rubbing resistance and hardness. Among the above, (meth)acrylate is particularly suitable. The (meth)acrylate refers to acrylate and methacrylate.

Specific examples of the polymerizable compound having a hydroxyl group in the molecule are mentioned below: pentaerythritol tri(meth)acrylate, pentaerythritol di(meth) acrylate, dipentaerythritol penta(meth)acrylate, ethylene oxide isocyanurate (EO)-modified di(meth)acrylate, 2-hydroxylethyl(meth)acrylate, 2-hydroxylpropyl(meth)acrylate, 2-hydroxybutyl(meth)acrylate, 4-hydroxybutyl(meth) acrylate, 2-hydroxy-3-phenoxypropyl(meth)acrylate, 2-hydroxy 3-(meth) acryloyloxypropyl methacrylate, glycerol dimethacrylate, 2-(meth)acryloyloxyethyl succinate, a pentaerythritol diacrylate-hexamethylene diisocyanate urethane polymer, a pentaerythritol diacrylate toluene-diisocyanate urethane polymer, a pentaerythritol diacrylate-isophorone diisocyanate urethane polymer, a dipentaerythritol tetraacrylate-hexamethylene diisocyanate urethane polymer.

Among the above, pentaerythritol triacrylate is particularly suitable.

It is also possible to use other polymerizable compounds in the range where the effects of the present invention are not impaired in order to adjust the viscosity of the coating agent, suppress shrinkage of the coating film of a coating agent in curing, and adjust the hardness of a resin film.

Conductive Inorganic Particles Whose Surface is Treated with Dispersing Agent Having Nitrogen Atom in Molecule Conductive Inorganic Particles The conductive inorganic particles are not particularly limited and specific examples are mentioned below.

Zinc antimonate particles, gallium-doped zinc oxide particles, antimony-doped tin oxide particles, indium-doped tin oxide particles, phosphorus-doped tin oxide particles, aluminum-doped zinc oxide particles, niobium-doped tin oxide particles, fluorine-doped tin oxide particles, and gallium-doped tin oxide particles are mentioned. Among the above, zinc antimonate particles are particularly suitably used. A plurality of kinds of the conductive inorganic particles may be used.

Dispersing Agent Having Nitrogen Atom in Molecule

As the dispersing agent having a nitrogen atom in the molecule, amine-based dispersing agents are mentioned. Specific examples are mentioned below.

Tri-n-butylamine, tri-n-pentylamine, tri-n-hexylamine, tri-n-heptylamine, tri-n-octylamine, tri-n-decylamine, tri-n-dodecylamine, dimethyl hexadecylamine, dimethyldodecylamine, dilauryl monomethylamine, dibutylamine, dihexylamine, dioctylamine, didecylamine, didodecylamine, butylamine, pentylamine, hexylamine, heptylamine, octylamine, and dodecylamine are mentioned. Among the above, tertiary amines are suitable because the dispersibility in the coating agent of the inorganic particles is excellent and tri-n-octylamine is more suitable. A plurality of kinds of dispersing agents may be used.

Surface Treatment with Dispersing Agent

The inorganic particles treated with the dispersing agent can be obtained by mixing a mixture containing inorganic particles, a dispersing agent, and a solvent in a bead mill for a given period of time. A commercially available dispersed slurry-like product can also be used.

The blending amount of the inorganic particles in the coating agent is suitably 1 to 50 parts by mass and more suitably 5 to 30 parts by mass based on 100 parts by mass of the polymerizable compound. By setting the blending amount of the inorganic conductive particles in the range mentioned above, the film formability of the coating agent can be further increased. Moreover, sufficient conductivity can be imparted to the resin film to be obtained.

The blending amount of the dispersing agent may be adjusted as appropriate according to the blending amount of the inorganic particles and is suitably 0.1 to 10 parts by mass and more suitably 1 to 3 parts by mass based on 100 parts by mass of the inorganic particles. By setting the blending amount of the dispersing agent in the range mentioned above, oozing of the dispersing agent from the resin film can be suppressed while sufficiently securing the dispersibility of the inorganic particles in the coating agent.

Interatomic Distance

In selecting a polymerizable compound having a hydroxyl group in the molecule and a dispersing agent having a nitrogen atom in the molecule, it is important to make the size of the polymerizable compound molecules and the size of the dispersing agent molecules the same.

In the molecules of the polymerizable compound, the interatomic distance between an oxygen atom in a hydroxyl group and the atom farthest away from the oxygen atom is represented by D1 and the interatomic distance between a nitrogen atom in the molecule of the dispersing agent and the atom farthest away from the nitrogen atom is represented by D2. At this time, due to the fact that D1 and D2 satisfy the relationship represented by the following formula (1), variations in the electrical resistance value of the resin film can be sufficiently suppressed irrespective of the elapsed time from the preparation of the coating agent.

$$[(|D1-D2|)/D2] \leq 0.30$$

It is more suitable that D1 and D2 satisfy the relationship represented by the following formula (2).

$$[(|D1-D2|)/D2] \leq 0.24$$

In calculating the interatomic distances, calculation by a molecular mechanics method (MM method) is used. In the present invention, the molecular structure was drawn by "Chem Draw Pro (version 11.0)" manufactured by CambridgeSoft, the structure was optimized by MM2 attached to "ChemBio3D Ultra (version 11.0)" manufactured by CambridgeSoft, the interatomic distance between an oxygen atom of a hydroxyl group of the polymerizable compound or a nitrogen atom of the dispersing agent and each atom in the molecule was measured, and then the largest value was defined as the interatomic distance from the furthest atom. The interatomic distance is the linear distance between the atoms when optimizing the structure of the molecules.

D1 is suitably a value of 4.0 Å or more and 50.0 Å or less and particularly suitably a value of 7.0 Å or more and 13.0 Å or less. D2 is suitably a value of 4.0 Å or more and 50.0 Å or less and particularly suitably a value of 6.0 Å or more and 17.0 Å or less.

Combinations of the polymerizable compound having a hydroxyl group in the molecule and the dispersing agent having a nitrogen atom in the molecule satisfying the relationship represented by the formula (1) above are shown in the following table 1 below. The combinations thereof may be combinations satisfying the relationship above and are not limited to the following combinations.

TABLE 1

| Polymerizable compound having hydroxyl group in molecule | Dispersing agent having nitrogen atom in molecule |
|---|---|
| Pentaerythritol triacrylate | Tri-n-pentylamine |
| Pentaerythritol triacrylate | Tri-n-hexylamine |
| Pentaerythritol triacrylate | Tri-n-hepthylamine |
| Pentaerythritol triacrylate | Tri-n-octylamine |
| Pentaerythritol triacrylate | Tris(1-methylpentyl)amine |
| Pentaerythritol triacrylate | Tris(1-methylhexyl)amine |
| Pentaerythritol triacrylate | Tris(1-methylhepthyl)amine |
| 2-hydroxylpropyl methacrylate | Tri-n-butylamine |
| 2-hydroxylpropyl methacrylate | Tri-n-pentylamine |
| 2-hydroxylpropyl methacrylate | Tri-n-hexylamine |
| 2-hydroxylpropyl methacrylate | Tri-n-heptylamine |
| 2-hydroxylpropyl methacrylate | Tris(1-methylpentyl)amine |
| 2-hydroxylpropyl methacrylate | Tris(1-methylhexyl)amine |
| 2-hydroxylpropyl methacrylate | Tris(1-methylhepthyl)amine |

TABLE 1-continued

| Polymerizable compound having hydroxyl group in molecule | Dispersing agent having nitrogen atom in molecule |
|---|---|
| 2-hydroxylpropyl methacrylate | Tri-n-octylamine |
| Pentaerythritol triacrylate | Tri-n-octylamine |
| 1,4-cyclohexane dimethanol monoacrylate | Tri-n-octylamine |
| 1,4-cyclohexane dimethanol monoacrylate | Tri-n-nonylamine |
| 1,4-cyclohexane dimethanol monoacrylate | Tri-n-decylamine |
| 1,4-cyclohexane dimethanol monoacrylate | Tri-n-undecylamine |
| 4-hydroxybutyl acrylate | Tri-n-dodecylamine |
| 4-hydroxybutyl acrylate | Tri-n-nonylamine |
| 4-hydroxybutyl acrylate | Tri-n-decylamine |
| 4-hydroxybutyl acrylate | Tri-n-undecylamine |
| 4-hydroxybutyl acrylate | Tri-n-dodecylamine |

Solvent

As the type of the solvent, a solvent which can be stably dissolved and dispersed is selected as appropriate according to the polymerizable compound and the inorganic conductive particles. Examples of the solvent include water; alcohols, such as methanol, ethanol, isopropanol, butanol, and octanol; ketones, such as acetone, cyclohexanone, and 2-butanone; esters, such as ethyl acetate, butyl acetate, ethyl lactate, γ-butyro lactone, propylene glycol-monomethylether acetate, and propylene glycol monoethyl ether acetate; ethers, such as ethylene glycol monomethylether and diethylene glycol monobutylether; aromatic hydrocarbons, such as benzene, toluene, and xylene; and amides, such as dimethyl formamide, dimethyl acetamide, and N-methyl pyrrolidone. Among the above, methyl isobutyl ketone, methyl ethyl ketone, cyclohexanone, propylene glycol monomethylether acetate, propylene glycol monoethylether acetate, toluene, and xylene are mentioned, and particularly ketones are suitable and among the ketones, 2-butanone is suitable. In order to adjust the evaporation rate and the viscosity, a plurality of solvents can also be used.

Others

The following components can be blended in the coating agent as necessary.

Radical Polymerization Initiator

Examples of radical polymerization initiators include, for example, compounds (thermal polymerization initiator) which thermally generate active radical species and compounds (radiation (light) polymerization initiator) which generate active radical species by irradiation with radiation rays (light).

As the radiation (light) polymerization initiator, any substance is used without particular limitation insofar as the substance can generate radicals by decomposition by light irradiation to initiate polymerization. The radiation (light) polymerization initiator includes, for example, acetophenone, acetophenone benzylketal, 1-hydroxycyclohexyl phenyl ketone, 2,2-dimethoxy-1,2-diphenylethane-1-on, xanthone, fluorenone, benzaldehyde, fluorene, anthraquinone, triphenylamine, carbazole, 3-methyl acetophenone, 4-chlorobenzophenone, 4,4-dimethoxy benzophenone, 4,4'-diamino benzophenone, benzoin propylether, benzoin ethylether, benzyl dimethylketal, 1-(4-isopropylphenyl)-2-hydroxy-2-methylpropane-1-on, 2-hydroxy-2-methyl-1-phenylpropane-1-on, thioxanthone, diethylthioxanthone, 2-isopropyl thioxanthone, 2-chlorothioxanthone, 2-methyl-1-[4-(methylthio)phenyl]-2-morpholino-propane-1-on, 2-benzyl-2-dimethylamino-1-(4-morpholinophenyl)-butanone-1,4-(2-hydroxyethoxy)phehyl-(2-hydroxy-2-propyl) ketone, 2,4,6-trimethyl benzoyl diphenyl phosphine oxide, bis-(2,6-dimethoxy benzoyl)-2,4,4-trimethyl pentyl phosphine oxyde, and origo(2-hydroxy-2-methyl-1-(4-(1-methylvinyl)phenyl)propanone.

The blending amount of the radical polymerization initiator is suitably 0.01 to 10 parts by mass and more suitably 0.1 to 5 parts by mass based on 100 parts by mass of the polymerizable compound. When the blending amount is 0.01 parts by mass or more, the hardness when formed into a cured substance is sufficiently obtained. Due to the fact that the blending amount is 10 parts by mass or less, a coating film can be cured up to the inside (lower layer).

Others

Other components can be added to the coating agent as necessary in the range where the effects of the present invention are not impaired. For example, a polymerization inhibitor, a polymerization initiation assistant, a leveling agent, a wettability improvement agent, a surfactant, a plasticizer, an ultraviolet absorber, an antioxidant, an antistatic agent, an inorganic filler, and pigment can be blended.

Method for Preparing Coating Agent

The method for preparing the coating agent is not particularly limited. However, since the inorganic particle is a particle-like substance and the polymerizable compound has high viscosity in many cases, the coating agent is suitably produced as follows in order to uniformly mix the inorganic particle and the polymerizable compound.

A slurry in which inorganic particles treated with a dispersing agent are dispersed in a solvent and a solution in which a polymerizable compound component is dissolved in a solvent are individually prepared, the slurry, the solution, a solvent, and other components of the compositions described later are placed in a container with a stirrer, and then stirred at normal temperature for 30 minutes to obtain a coating agent.

Electrophotographic Member and Method for Producing the Same

The coating agent can be formed into a conductive resin film by applying the same onto a substrate, and then curing the same. The conductive resin film can be used for an antistatic film and an electrophotographic member, such as an intermediate transferring belt.

The coating agent makes it had to produce a difference in conductivity between a conductive resin film formed using a coating agent immediately after the preparation thereof and a conductive resin film formed using a coating of which a certain period of time has been lapsed from the preparation. Therefore, in a method for producing an electrophotographic member having (a) a process of forming a coating film of a coating agent onto a substrate and (b) a process of curing the coating film formed in the process (a) to form a conductive resin film, it is possible to produce a plurality of electrophotographic members having uniform quality by repeatedly performing the process (a) to a plurality of substrates. More specifically, the coating agent enables mass-production of an electrophotographic member having a stable quality.

Hereinafter, an electrophotographic member according to one embodiment of the present invention is described in detail taking an electrophotographic belt as an example.

Figure 1:
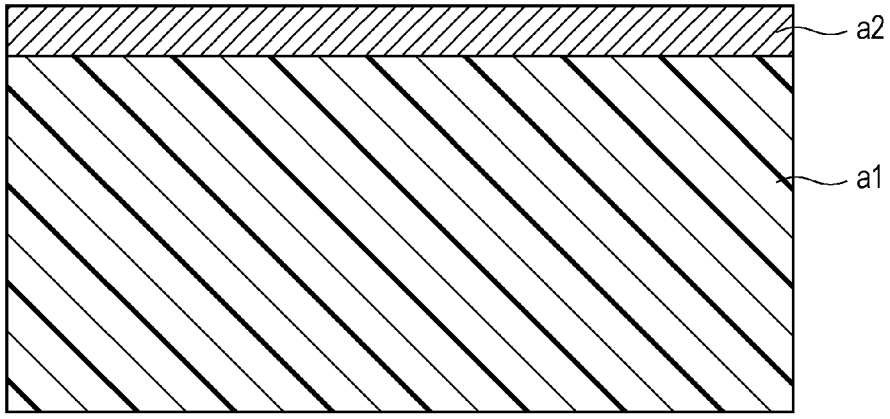
FIG. 1 is a cross-sectional schematic view of one embodiment of an electrophotographic member according to an aspect of the present invention.

FIG. 1 illustrates a cross sectional view of an electrophotographic belt which is one embodiment of the electrophotographic member according to an aspect of the present invention. The electrophotographic belt has a resin layer, which is formed by curing a coating film of a coating agent, as a surface layer a2 on a substrate a1.

Substrate

The thickness of the substrate a1 is generally 10 μm or more and 500 μm or less and particularly 30 μm or more and 150 μm or less.

Raw materials of the substrate are not particularly limited and various kinds of resin are used. Specific examples are mentioned below. Resins, such as polyimide (PI), polyamideimide (PAI), polypropylene (PP), polyethylene (PE), polyamide (PA), polylactic acid (PLLA), polyethylene terephthalate (PET), polyethylenenaphthalate (PEN), polyphenylene sulfide (PPS), polyetheretherketone (PEEK), polycarbonate (PC), and fluororesin (PVdF), and a blend resin thereof are suitable. Among the above, polyethylenenaphthalate (PEN) is particularly suitable.

Examples of the raw materials of the substrate include, in addition to the resin mentioned above, other components, such as ion conductive agents, (for example, polymer ion-based conductive agents and surfactants), conductive polymers, antioxidants (for example, hindered phenol-based antioxidants, phosphorus-based antioxidants, and sulfur-based antioxidants), ultraviolet absorbers, organic pigments, inorganic pigments, pH adjusters, crosslinking agents, compatibilizers, mold release agents (for example, silicone-based mold release agents and fluorine-based mold release agents), crosslinking agents, coupling agents, lubricants, insulating fillers (for example, zinc oxide, barium sulfate, calcium sulfate, barium titanate, potassium titanate, strontium titanate, titanium oxide, magnesium oxide, magnesium hydroxide, aluminium hydroxide, talc, mica, clay, kaolin, hydrotalcite, silica, alumina, ferrite, calcium carbonate, barium carbonate, nickel carbonate, glass powder, quartz powder, glass fiber, alumina fiber, potassium titanate fiber, and fine particles of thermosetting resin), conductive fillers (for example, carbon black, carbon fiber, conductive titanium oxide, conductive tin oxide, and conductive mica), and ionic liquid. These substances can be used alone or in a combination of two or more kinds thereof.

The method for producing the substrate is not particularly limited and molding methods suitable for various kinds of resin may be used. For example, extrusion molding, inflation molding, blow molding, and centrifugal molding are mentioned.

Surface Layer

A surface layer is formed by curing a coating film of the coating agent formed on the substrate.

As a method for forming the coating film of the coating agent, usual coating methods, e.g., dip coating, spray coating, flow coating, shower coating, roll coating, and spin coating, can be mentioned.

When a polymerizable compound having an acryl group is used as the polymerizable compound, a resin layer can be formed by curing the coating film of the coating agent by heat or radiation rays (light and electron beams).

In this case, the radiation rays are not particularly limited insofar as the radiation rays are active radiation rays which can impart energy capable of generating polymerization initiation species. Examples of the radiation rays include α-rays, γ-rays, X-rays, ultraviolet rays (UV), visible light, and electron beams. Among the above, ultraviolet rays and electron beams are suitable from the viewpoint of curing sensitivity and ease of availability of devices, and ultraviolet rays are particularly suitable.

According to one embodiment of the present invention, a coating agent capable of forming a conductive resin film in which changes in the electrical resistance value are suppressed irrespective of the length of the elapsed time from the preparation of the coating agent can be obtained. Moreover, according to another embodiment of the present invention, a conductive resin film having stable conductivity can be obtained. Furthermore, according to another embodiment of the present invention, there is provided a method for mass-producing an electrophotographic member capable of mass-producing an electrophotographic member, the member having a conductive resin layer with less conductivity variations.

EXAMPLES

The present invention is described in detail with reference to Examples and Comparative Examples but the scope of the present invention is not limited thereto.

In the formula of coating agents of Examples and Comparative Examples of the present invention, the added amount of inorganic conductive particles is adjusted in such a manner that the surface resistivity is approximately $4\times10^{10}\Omega/\square$ on the day of the preparation thereof because the electrical resistance value varies depending on the polymerizable compound, dispersing agent, and inorganic particles to be used.

Preparation of Coating Agent

Preparation of Coating Agent No. 1

Each component shown in Table 2 below was weighed, injected into a container, and then stirred with a magnetic stirrer at 100 rpm for 30 minutes to obtain a slurry containing zinc antimonate whose surface was treated with tri-n-octylamine.

TABLE 2

| | |
|---|---|
| Conductive inorganic particles<br>Zinc antimonite<br>(Trade name: CELNAX CX-Z400K (40% solid content): manufactured by Nissan Chemical Industries, Ltd. | 41 parts by weight |
| Dispersion agent having nitrogen atom in molecule<br>tri-n-octylamine (manufactured by Kishida Chemical Co., Ltd.) | 0.41 parts by weight |
| Solvent<br>2-butanone (manufactured by Kishida Chemical Co., Ltd.) | 450 parts by weight |

Each component shown in Table 3 below was mixed to obtain a solution of a polymerizable compound.

TABLE 3

| | |
|---|---|
| Polymerizable compound<br>Pentaerythritol triacrylate<br>(Trade name: A-TMM-3LM-N: manufactured by Shin-Nakamura Chemical Co., Ltd.) | 100 parts by weight |
| Polymerization initiator<br>IRGACURE907 (manufactured by BASF) | 5 parts by weight |
| Solvent<br>2-butanone | 0.1 parts by weight |

Subsequently, the obtained slurry containing the zinc antimonate whose surface was treated with a dispersing agent, the obtained solution of a polymerizable compound, 0.1 parts by mass of a leveling agent (Trade name: BYK-Silclean3700, manufactured by BYK Chemie) were placed in a stirring vessel (formed with stainless steel), and then stirred with a magnetic stirrer at 100 rpm for 10 minutes to obtain a coating agent No. 1 according to Example 1.

(Preparation of Coating Liquid No. C1)

A coating agent No. C1 according to Comparative Example 1 was obtained in the same manner as that of the coating liquid No. 1, except changing the amount of zinc antimonate to 45 parts by mass, changing tri-n-octylamine to tri-n-propylamine, and changing the blending amount to 0.45 parts by mass.

Preparation of Coating Liquid No. C2

A coating agent No. C2 according to Comparative Example 2 was obtained in the same manner as that of the coating liquid No. 1, except changing the amount of zinc antimonate to 43 parts by mass, changing tri-n-octylamine to tri-n-butylamine, and changing the blending amount to 0.43 parts by mass.

Calculation of D1 and D2

With respect to the coating agent No. 1 and the coating agents Nos. C1 and C2, the interatomic distance (D1) between an oxygen atom of a hydroxyl group of the polymerizable compound and the atom farthest away from the oxygen atom and the interatomic distance (D2) between a nitrogen atom the atom farthest away from the nitrogen atom in the molecule of the dispersing agent were determined for each molecule of the polymerizable compound and the dispersing agent which was subjected to the structure optimization by MM2 by performing calculation according to the molecular mechanics method (MM method) as described above. Moreover, the values of (|D1−D2|)/D2 were calculated. The results are shown Table 4.

TABLE 4

| | Polymerizable compound | Inorganic particles | Dispersing agent | D1 | D2 | [(D1 − D2)/D2] |
|---|---|---|---|---|---|---|
| Comparative Example 1 | Pentaerythritol triacrylate | Zinc antimonite | Tri-n-propylamine | 8.4 | 4.7 | 0.79 |
| Comparative Example 2 | | | Tri-n-butylamine | 8.4 | 6.0 | 0.40 |
| Example 1 | | | Tri-n-octylamine | 8.4 | 10.3 | 0.18 |

Observation of Secular Changes in Average Particle Diameter of Conductive Inorganic Particles The coating agent No. 1 and the coating agents Nos. C1 and C2 were measured for the average particle diameter of the inorganic particles until 61 days passed from the day following the preparation thereof as the 1st day, and then secular changes in the dispersion state of the inorganic particles were observed. For the measurement of the average particle diameter of the inorganic particles, a particle diameter measuring apparatus (Trade name: ELSZ1000-ZS, manufactured by Otsuka Electronics Co., Ltd.) was used and the analysis was performed by cumulant method analysis. The results are shown in Table 5.

The results showed that the coating agent No. 1 and the coating agents Nos. C1 to C2 were able to maintain the state where the inorganic particles were stably dispersed even when 61 days passed after the preparation thereof.

TABLE 5

| | Number of elapsed days after preparation of coating agent | | | | | | | | | |
|---|---|---|---|---|---|---|---|---|---|---|
| | 1 day later | 2 days later | 7 days later | 8 days later | 15 days later | 29 days later | 30 days later | 31 days later | 60 days later | 61 days later |
| Example 1 | 165.1 | — | — | 156.6 | 163 | — | 159.3 | — | 162.2 | — |
| Comparative Example 1 | 163.6 | — | — | 159.7 | 162.1 | 165.9 | — | — | — | 161.5 |
| Comparative Example 2 | — | 162.1 | 160 | — | — | — | 161.5 | — | 165.1 | — |

Unit: nm

Production of Electrophotographic Belt

Production of Electrophotographic Belts Nos. 1-1 and 1-2

Production of Substrate

First, the resin materials shown in Table 6 below were thermally melted and kneaded using a biaxial extruder (Trade name: TEX30α, manufactured by Japan Steel Works, Ltd.) to prepare a thermoplastic resin composition. The thermally melting and kneading temperature was adjusted to be within the range of 260° C. or higher and 280° C. or less and the thermally melting and kneading time was adjusted to about 3 to 5 minutes. The obtained thermoplastic resin composition was pelletized, and then dried at a temperature of 140° C. for 6 hours. Subsequently, the dried pellet-like thermoplastic resin composition was charged into an injection molding apparatus (Trade name: SE180D, manufactured by Sumitomo Heavy Industries, Ltd.). Then, the thermoplastic resin composition was injection-molded in a die having a temperature adjusted to 30° C. under a condition where the cylinder preset temperature was 295° C. to produce a preform. The obtained preform had a test tube shape having an outer diameter of 20 mm, an internal diameter of 18 mm, and a length of 150 mm.

TABLE 6

| Resin material | Blending amount |
|---|---|
| PET: Polyethylene terephthalate (Trade name: TR-8550, manufactured by Teijin Chemicals, Ltd.) | 100 parts by weight |
| PEEA: Polyetheresteramide (Trade name: Pelestat NC6321, manufactured by Sanyo Chemical Industries, Ltd.) | 20 parts by weight |
| Electrolytic component: Potassium perfluorobutane sulfonate salt | 1.5 parts by weight |
| CB: Carbon black (Trade name: MA-100, manufactured by Mitsubishi Chemical Corporation) | 1 part by weight |

Figure 2:
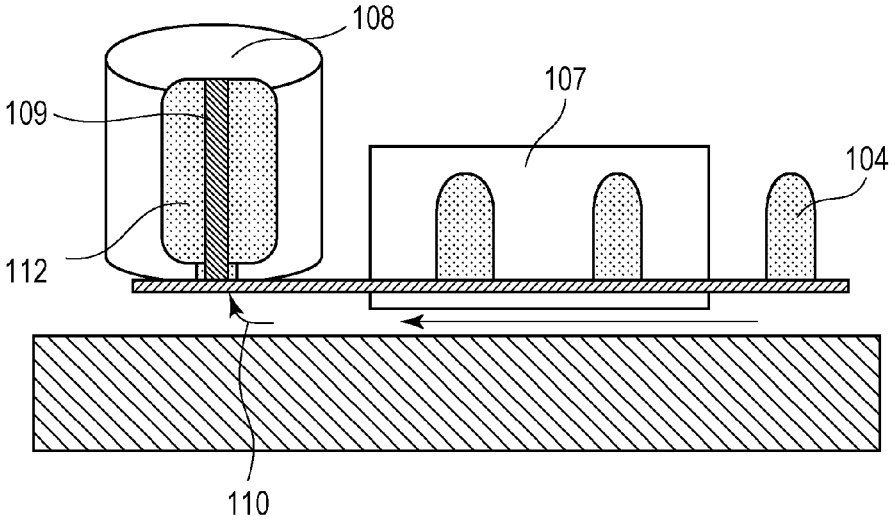
FIG. 2 is a schematic view of a stretch blow molding machine for use in producing a substrate in one embodiment of the electrophotographic member according to an aspect of the present invention.

Next, the preform was biaxially stretched using a biaxially stretching apparatus (stretch blow molding machine) illustrated in FIG. 2. Before biaxially stretching, a preform 104 was placed in a heating device 107 having a noncontact heater (not illustrated) for heating the outer wall and the inner wall of the preform 104, and then heated with the heating heater in such a manner that the outer surface temperature was 120° C. Subsequently, the heated preform 104 was placed in a blow die 108 in which the die temperature was held at 30° C., and then stretched in the axial direction using a stretching rod 109. Simultaneously therewith, the air whose temperature was adjusted to a temperature of 23° C. was introduced into the preform from a blow air injection portion 110 to stretch the preform 104 in the radial direction. Thus, a bottle-like molded product 112 was obtained.

Subsequently, a trunk portion of the obtained bottle-like molded product 112 was cut to obtain a seamless substrate of an electrophotographic belt. The thickness of the substrate was 70 μm and the surface resistivity of the substrate was $3\times10^{10}\Omega/\square$. Two pieces of the substrates were prepared.

Formation of Conductive Resin Layer (Surface Layer)

The two substrates obtained by the blow molding were individually fitted to the outer circumference of a cylindrical mold, and then the end portion was sealed. Then, the substrates were dipped in a container charged with the coating agent No. 1 immediately after the preparation thereof together with the mold, and then pulled up in such a manner that the relative velocity between the liquid surface of the coating agent No. 1 and the substrate was fixed, whereby a coating film of the coating agent was formed on the substrate surface. The pulling-up rate (Relative velocity between the liquid surface of the coating agent and the substrate) and the solvent ratio of the coating agent are adjusted according to the desired film thickness of the surface layer. In Example 1, the pulling-up rate was adjusted in the range of 10 to 50 mm/second in such a manner that the film thickness of the surface layer was about 2 μm.

The coating film of the coating agent No. 1 was formed on the outer surface of the substrate, and then dried for 1 minute in an environment of a temperature of 23° C. and a relative humidity of 50% in an exhaust air stream. Then, the surface of the coating film was irradiated with ultraviolet rays using a UV irradiation machine (Trade name: UE06/81-3, manufactured by Eye Graphics Co., Ltd.) until the cumulative light amount was 600 mJ/cm$^2$ to cure the coating film, whereby an electrophotographic belt No. 1-1 according to Example 1 having a conductive resin film on the outer surface of the substrate was obtained.

Moreover, an electrophotographic belt No. 1-2 was obtained similarly as above using the coating agent No. 1 in which the number of the elapsed days from the preparation thereof was 30 days.

Production of Electrophotographic Belts Nos. C1-1 and C1-2

Electrophotographic belts according to Comparative Example 1 were produced using a method similar to the method for producing the electrophotographic belts Nos. 1-1 and 1-2, except changing the coating agent No. 1 to the coating agent No. C1. Herein, the electrophotographic belt produced using the coating agent No. C1 immediately after the preparation thereof was referred to as No. C1-1 and the electrophotographic belt produced using the coating agent No. C1 in which the number of the elapsed days from the preparation thereof was 30 days was referred to as an electrophotographic belt No. C1-2.

Production of Electrophotographic Belts No. C2-1 and C2-2

Electrophotographic belts according to Comparative Example 2 were produced using a method similar to the method for producing the electrophotographic belts No. 1-1 and 1-2, except changing the coating agent No. 1 to the coating agent No. C2. Herein, the electrophotographic belt produced using the coating agent No. C2 immediately after the preparation thereof was referred to as No. C2-1 and the electrophotographic belt produced using the coating agent No. C2 in which the number of the elapsed days from the preparation thereof was 30 days was referred to as an electrophotographic belt No. C2-2.

Secular Changes in Electrical Resistance Value

The increase in the electrical resistance value of the resin film produced using the coating agent in which the number of the elapsed days from the preparation thereof was 30 days was defined as the index of the secular changes. More specifically, the surface resistivities of the electrophotographic belt No. 1-1 and the electrophotographic belt No. 1-2 were measured, the common logarithms of the measured values were determined, and then a difference thereof was defined as the value of the secular changes.

The surface resistivity of the electrophotographic belt was measured using a resistance meter (Trade name: Hiresta UP MCP-HT450, manufactured by Mitsubishi Chemical Analytech Co., Ltd.). The probe that was used, the measurement voltage, and the measuring time were a UR100 type probe, 250 V, and 10 seconds, respectively.

The electrophotographic belts Nos. C1-1 and C1-2 (Comparative Example 1) and the electrophotographic belts Nos. C2-1 and C2-2 (Comparative Example 2) were also similarly determined for the values of the secular changes. The results are shown in Table 7 below.

TABLE 7

| | Secular changes in electrical resistance value |
|---|---|
| Comparative Example 1 | 0.33 |
| Comparative Example 2 | 0.29 |
| Example 1 | 0.01 |

Image Evaluation

The electrophotographic belt No. 1-1 and the electrophotographic belt No. 1-2 according to Example 1 were individually placed as an intermediate transferring belt in an intermediate transferring unit of a laser beam printer (Trade name: LBP-5200, manufactured by CANON KABUSHIKI KAISHA), and then images were output using A4 size paper (Trade name: Canon Extra Multifunctional Paper 80 g/m$^2$, manufactured by CANON KABUSHIKI KAISHA) in an environment of a temperature and relative humidity of 15° C. and 10% RH. The images were magenta halftone images. The 100th halftone image obtained using the electrophotographic belt No. 1-1 and the 100th halftone image obtained using the electrophotographic belt No. 1-2 were checked for the presence or absence of image unevenness due to toner scattering caused by discharging. Consequently, the image unevenness due to toner scattering was not observed in the electrophotographic belt No. 1 and the electrophotographic belt No. 1-2, and good images were obtained.

The image evaluation was similarly performed for the electrophotographic belts Nos. 2-1 and 2-2 and the electrophotographic belts No. 3-1 and 3-2. Consequently, the image unevenness due to toner scattering was not observed in the electrophotographic belt No. 2-1 and the electrophotographic belt No. 3-1 but the image unevenness due to toner scattering was observed in the electrophotographic belt No. 2-2 and the electrophotographic belt No. 3-2.

Examples 2 to 5 and Comparative Examples 3 to 7

Coating agents Nos. 2 to 5 according to Examples 2 to 5 and coating agents Nos. C3 to C7 according to Comparative Examples 3 to 7 were prepared in the same manner as that of the coating agent No. 1, except that the raw materials and the blending amounts of the coating agents were changed as shown in Table 8 below.

TABLE 8

| | Comparative Examples | | Example | Comparative Examples | | Example | Comparative Example | Examples | |
|---|---|---|---|---|---|---|---|---|---|
| Material | 3 | 4 | 2 | 5 | 6 | 3 | 7 | 4 | 5 |
| Pentaerythritol triacrylate | 100 | 100 | 100 | 100 | 100 | 100 | — | — | — |
| 2-hydroxylpropyl methacrylate | — | — | — | — | — | — | 100 | 100 | 100 |
| Zinc antimonite | — | — | — | — | — | — | 43 | 42 | 40 |
| Gallium-doped zinc oxide | 50 | 48 | 46 | — | — | — | — | — | — |
| Antimony-doped tin oxide | — | — | — | 52 | 50 | 48 | — | — | — |
| Tri-n-propylamine | 0.5 | | — | 0.52 | — | — | 0.43 | — | — |
| Tri-n-butylamine | | 0.48 | — | — | 0.5 | — | — | 0.42 | — |
| Tri-n-octylamine | | | 0.46 | — | — | 0.48 | — | — | 0.4 |
| 2-butanone (solvent) | 450 | 450 | 450 | 450 | 450 | 450 | 450 | 450 | 450 |
| Polymerization initiator | 5 | 5 | 5 | 5 | 5 | 5 | 5 | 5 | 5 |
| Leveling agent | 0.1 | 0.1 | 0.1 | 0.1 | 0.1 | 0.1 | 0.1 | 0.1 | 0.1 |

Unit: part(s) by mass

With respect to these coating agents, the interatomic distances D1 and D2 were determined and also the values of (|D1−D2|)/D2] were calculated in the same manner as that of the coating agent No. 1. The results are shown in Table 9 below.

TABLE 9

| | Resin monomer | Inorganic conductive particles | Dispersing agent | D1 (Å) | D2 (Å) | [(D1 − D2)/D2] |
|---|---|---|---|---|---|---|
| Comparative Example 3 | Pentaerythritol triacrylate | Gallium-doped zinc oxide | Tri-n-propylamine | 8.4 | 4.7 | 0.79 |
| Comparative Example 4 | | | Tri-n-butylamine | 8.4 | 6.0 | 0.40 |
| Example 2 | | | Tri-n-octylamine | 8.4 | 10.3 | 0.18 |
| Comparative Example 5 | | Antimony-doped tin oxide | Tri-n-propylamine | 8.4 | 4.7 | 0.79 |
| Comparative Example 6 | | | Tri-n-butylamine | 8.4 | 6.0 | 0.40 |
| Example 3 | | | Tri-n-octylamine | 8.4 | 10.3 | 0.18 |
| Comparative Example 7 | 2-hydroxylpropyl methacrylate | Zinc antimonate | Tri-n-propylamine | 7.8 | 4.7 | 0.66 |
| Example 4 | | | Tri-n-butylamine | 7.8 | 6.0 | 0.30 |
| Example 5 | | | Tri-n-octylamine | 7.8 | 10.3 | 0.24 |

Subsequently, electrophotographic belts Nos. 2-1, 2-2, 3-1, 3-2, 4-1, 4-2, 5-1, and 5-2 and C3-1, C3-2, C4-1, C4-2, C5-1, C5-2, C6-1, C6-2, C7-1, and C7-2 were produced in the same manner as in Example 1, except using these coating agents Nos. 2 to 5 and C3 to C7. The obtained electrophotographic belts were evaluated for the secular changes in the electrical resistance value and images in the same manner as in Example 1. The results are shown in Table 10 below.

The criteria of the image evaluation ranks are as follows.

Rank 1: The image unevenness due to toner scattering was not observed in the electrophotographic belt using the coating agent in which the number of the elapsed days from the preparation thereof was 30 days.

Rank 2: The image unevenness due to toner scattering was observed in the electrophotographic belt using the coating agent in which the number of the elapsed days from the preparation thereof was 30 days.

TABLE 10

| | Secular changes in electrical resistance value | Image evaluation rank |
|---|---|---|
| Comparative Example 3 | 0.45 | 2 |
| Comparative Example 4 | 0.30 | 2 |
| Example 2 | 0.03 | 1 |
| Comparative Example 5 | 0.40 | 2 |
| Comparative Example 6 | 0.25 | 2 |
| Example 3 | 0.01 | 1 |
| Comparative Example 7 | 0.25 | 2 |
| Example 4 | 0.05 | 2 |
| Example 5 | −0.01 | 1 |

The trade names and the manufacturers of the raw materials used for the preparation of the coating agents Nos. 1 to 5 and C1 to C7 are shown in Table 11 below.

TABLE 11

| Material | Product |
|---|---|
| Pentaerythritol triacrylate | A-TMN-3LM-N, manufactured by Shin-Nakamura Chemical Co., Ltd. |
| 2-hydroxylpropyl methacrylate | Light ester HOP, manufactured by Kyoeisha Chemical Co., Ltd. |
| Zinc antimonite | CELNAX CX-Z400K (40% solid content), manufactured by Nissan Chemical Industries, Ltd. |
| Gallium-doped zinc oxide | Nanotech powder GZO, manufactured by CIK Nanotech Co., Ltd. |
| Antimony-doped tin oxide | T-1, manufactured by Mitsubishi Materials Electronic Chemicals Co., Ltd. |
| Tri-n-propylamine | Tri-n-propylamine, manufactured by Kishida Chemical Co., Ltd. |
| Tri-n-butylamine | Tri-n-butylamine, manufactured by Kishida Chemical Co., Ltd. |
| Tri-n-octylamine | Tri-n-octylamine, manufactured by Kishida Chemical Co., Ltd. |
| 2-butanone | 2-butanone, manufactured by Kishida Chemical Co., Ltd. |
| Polymerization initiator | IRGACURE907 (manufactured by BASF) |
| Leveling agent | BYK-Silclean3700, manufactured by BYK Chemie |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-109048, filed on May 27, 2014 and No. 2015-057750, filed on Mar. 20, 2015, which are hereby incorporated by reference herein in their entirety.

What is claimed is:

1. A coating agent comprising:

a polymerizable compound having a hydroxyl group in a molecule thereof, a conductive inorganic particle coated with a dispersant having a nitrogen atom in a molecule thereof, and a solvent, wherein, when an interatomic distance between an oxygen atom in the hydroxyl group and an atom farthest away from the oxygen atom in the molecule of the polymerizable compound is represented by D1 and an interatomic distance between the nitrogen atom and an atom farthest away from the nitrogen atom in the molecule of the dispersant is represented by D2, wherein D1 and D2 satisfy a relationship represented by the following formula (1):

$$(|D1-D2|)/D2]\leq 0.30 \quad (1).$$

2. The coating agent according to claim 1, wherein the polymerizable compound is (meth)acrylate or urethane (meth)acrylate.

3. The coating agent according to claim 1, wherein the dispersant is tertiary amine.

4. The coating agent according to claim 1, wherein D1 and D2 satisfy a relationship represented by the following formula (2):

$$(|D1-D2|)/D2]\leq 0.24 \quad (2).$$

5. The coating agent according to claim 1, wherein the polymerizable compound is pentaerythritol triacrylate.

6. The coating agent according to claim 3, wherein the dispersant is tri-n-octylamine.

7. A method for producing an electrophotographic member having a substrate and a resin film formed on the substrate comprising:

applying the coating agent according to claim 1 on the substrate to form a coating film; and then curing the coating film.

* * * * *